US007978866B2

(12) United States Patent
Oteki

(10) Patent No.: US 7,978,866 B2
(45) Date of Patent: Jul. 12, 2011

(54) ACOUSTICS CORRECTING APPARATUS

(75) Inventor: Hideyasu Oteki, Kanagawa (JP)

(73) Assignee: Sony Corporation, Tokyo (JP)

( * ) Notice: Subject to any disclaimer, the term of this patent is extended or adjusted under 35 U.S.C. 154(b) by 1083 days.

(21) Appl. No.: 11/560,633

(22) Filed: Nov. 16, 2006

(65) Prior Publication Data

US 2007/0147636 A1 Jun. 28, 2007

(30) Foreign Application Priority Data

Nov. 18, 2005 (JP) ..... 2005-334711

(51) Int. Cl.
*H04R 5/02* (2006.01)
*H04R 29/00* (2006.01)
*H04R 3/00* (2006.01)

(52) U.S. Cl. ..... 381/310; 381/59; 381/96

(58) Field of Classification Search ..... 381/58, 381/59, 56, 96, 310, 17, 300
See application file for complete search history.

(56) References Cited

U.S. PATENT DOCUMENTS

| | | | | |
|---|---|---|---|---|
| 6,222,930 | B1 | 4/2001 | Nakano et al. | |
| 6,546,105 | B1 * | 4/2003 | Katayama et al. | 381/17 |
| 2005/0244012 | A1 * | 11/2005 | Asada | 381/56 |
| 2007/0133813 | A1 | 6/2007 | Morishima | |

FOREIGN PATENT DOCUMENTS

| | | |
|---|---|---|
| EP | 0 637 191 A2 | 7/1994 |
| JP | 08-194027 | 7/1996 |
| JP | 10-224900 | 8/1998 |
| JP | 2000-295698 | 10/2000 |
| JP | 2002-034100 | 1/2002 |
| JP | 2004-166106 | 6/2004 |
| JP | 2005-198249 | 7/2005 |
| WO | WO 2005/079114 A1 | 8/2005 |

OTHER PUBLICATIONS

Japanese Office Action issued Sep. 14, 2010, in Patent Application No. 2005-334711.

* cited by examiner

*Primary Examiner* — Curtis Kuntz
*Assistant Examiner* — Hai Phan
(74) *Attorney, Agent, or Firm* — Oblon, Spivak, McClelland, Maier & Neustadt, L.L.P.

(57) ABSTRACT

An acoustics correcting apparatus includes: a measurement signal supplying section; first and second collecting sections; a first distance calculating section; a second distance calculating section; a position information calculating section; an acoustics measuring section; a virtual sound image coefficient selecting section; a correction characteristic calculating section; a virtual sound image localization processing section; and an acoustics correcting section.

6 Claims, 11 Drawing Sheets

| | |
|---|---|
| G1 | $H\theta 2R/(H\theta 1L \times H\theta 2R - H\theta 1R \times H\theta 2L)$ |
| G2 | $-H\theta 1R/(H\theta 1L \times H\theta 2R - H\theta 1R \times H\theta 2L)$ |
| G3 | $H\theta 1L/(H\theta 1L \times H\theta 2R - H\theta 1R \times H\theta 2L)$ |
| G4 | $-H\theta 2L/(H\theta 1L \times H\theta 2R - H\theta 1R \times H\theta 2L)$ |

| | |
|---|---|
| H1 | $\sum_{i=1} H\Phi aLi = H\Phi aL1 + H\Phi aL2 + H\Phi aL3 + H\Phi aL4$ |
| H2 | $\sum_{i=1} H\Phi aRi = H\Phi aR1 + H\Phi aR2 + H\Phi aR3 + H\Phi aR4$ |
| H3 | $\sum_{i=1} H\Phi bRi = H\Phi bR1 + H\Phi bR2 + H\Phi bR3 + H\Phi bR4$ |
| H4 | $\sum_{i=1} H\Phi bLi = H\Phi bL1 + H\Phi bL2 + H\Phi bL3 + H\Phi bL4$ |

ACOUSTICS CORRECTING APPARATUS

CROSS REFERENCES TO RELATED APPLICATIONS

The present invention contains subject matter related to Japanese Patent Application JP 2005-334711 filed in the Japanese Patent Office on Nov. 18, 2005, the entire contents of which being incorporated herein by reference.

BACKGROUND OF THE INVENTION

1. Field of the Invention

The present invention relates to an acoustics correcting apparatus for correcting the acoustics of an audio system including multiple speakers to a desired characteristic.

2. Description of the Related Art

In order to obtain high quality acoustics in an acoustics in a surround acoustic apparatus including multiple speakers, for example, which can add realism like that in a concert hall or a theater, the multiple speakers may be placed at proper positions with reference to a listening position where a user listens to the sound.

However, an indoor environment having such a surround acoustic apparatus generally has various factors, and the arrangement of the speakers is limited.

An acoustics correcting apparatus for correcting the acoustics of the acoustic apparatus to a desired one may measure the acoustics such as the presence of speakers, the distance from a listening position to speakers, the sound-pressure level of the sound at a listening position, which is reproduced by the speakers, the frequency response characteristic and the reaching time, adjust the voice signal reaching time from the speakers to the listening position, averages the reproducing levels among the speakers, and corrects the acoustics such as the frequency response characteristic in a reproduced acoustic space.

Furthermore, in order to improve the reproducing environment by the acoustic apparatus, so-called virtual sound image localization processing is desirably performed which well processes the reduction of the reproducing environment due to the displacement from proper arranged angles of the speakers.

In the past, a virtual sound image localization processing section is provided in an AV receiver or a DVD's internal audio amplifier, for example, in order to perform virtual sound image localization processing. The virtual sound image characteristic coefficient, which may be required in the virtual sound image localization processing section, depends on the position where a speaker thereof is placed.

However, the virtual sound image characteristic coefficient is determined by separately defining the position to place a speaker by a listener since an acoustics correcting apparatus in the past may not identify the direction where the speaker is placed.

JP-A-10-224900 is exemplified as a related art.

SUMMARY OF THE INVENTION

It is desirable to propose an acoustic correcting apparatus, which can automatically define an optimum virtual sound image characteristic coefficient.

According to an embodiment of the present invention, there is provided an acoustics correcting apparatus including a measurement signal supplying section supplying a measurement signal for measurement to multiple speakers at arbitrary positions, first and second collecting sections spaced apart from each other and collecting sound output from the speakers with the supplied measurement signal, a first distance calculating section calculating the distance from each of the speakers to the first collecting section based on the first collected signal captured by the first collecting section and the measurement signal, a second distance calculating section calculating the distance from each of the speakers to the second collecting section based on the second collected signal captured by the second collecting section and the measurement signal, a position information calculating section calculating position information of each of the speakers from the first and second collecting sections based on the distances form each of the speakers calculated by the first and second distance calculating sections to the first and second collecting sections, an acoustics measuring section measuring acoustics by the multiple speakers placed at the arbitrary positions based on the first and second collected signals and the measurement signal, a virtual sound image coefficient selecting section selecting an optimum virtual sound image coefficient from multiple virtual sound image coefficients based on the position information calculated by the position information calculating section, a correction characteristic calculating section calculating an optimum correction characteristic based on the acoustics measured by the acoustics measuring section, a virtual sound image localization processing section performing virtual sound image localization processing on reproduce signals for the speakers based on the virtual sound image coefficient selected by the virtual sound image coefficient selecting section, and an acoustics correcting section correcting the acoustics of the reproduce signals for the speakers based on the correction characteristic calculated by the correction characteristic calculating section.

According to another embodiment of the invention, there is provided an acoustic correcting apparatus that corrects the acoustics of multiple speakers placed at arbitrary positions and performs virtual sound image localization processing based on measurement data measured from first and second collected signals obtained by collecting the sound output by supplying a measurement signal for measurement to the multiple speakers first and second collecting sections spaced apart from each other by a predetermined distance, the apparatus including a first processing section, based on the measurement data, calculating a correction characteristic that corrects acoustics and calculating a virtual sound image characteristic coefficient for performing virtual sound image localization processing, a storage section storing an acoustics measuring program causing to measure the measurement data abased on the first and second collected signals, a virtual sound image localization processing program causing to perform virtual sound image localization processing on reproduce signals for the speakers based on the virtual sound image characteristic coefficient, and acoustics correcting program correcting the acoustics of the reproduce signals for the speakers based on the correction characteristic, and a second processing section reading the acoustics measurement program to supply a measurement signal for measurement to the multiple speakers, measuring the acoustics of the speakers from first and second collected signals by collecting the sound output from the multiple speakers that receive the supply of the measurement signal by the first and second collecting sections and calculating the distances from the speakers to the first and second collecting sections from the first and second collected signals and calculating position information of the speakers from the distances, wherein the first processing section calculates the correction characteristic based on the acoustics measured by the second processing section and selects an optimum virtual sound image coefficient based on the position information calculated by the second processing section; and the second processing section performs virtual sound image localization processing on the reproduce signals and corrects the acoustics based on the correction characteristic and the virtual sound image characteristic coefficient, which are calculated by the first processing section, by reading the virtual sound image localization processing program and acoustics correcting program.

According to the embodiments of the invention, virtual sound image localization processing can be performed by correcting acoustics and automatically defining an optimum virtual sound image characteristic coefficient.

DESCRIPTION OF THE PREFERRED EMBODIMENTS

With reference to drawings, an acoustics correcting apparatus according to embodiments of the invention will be described below.

Figure 1:
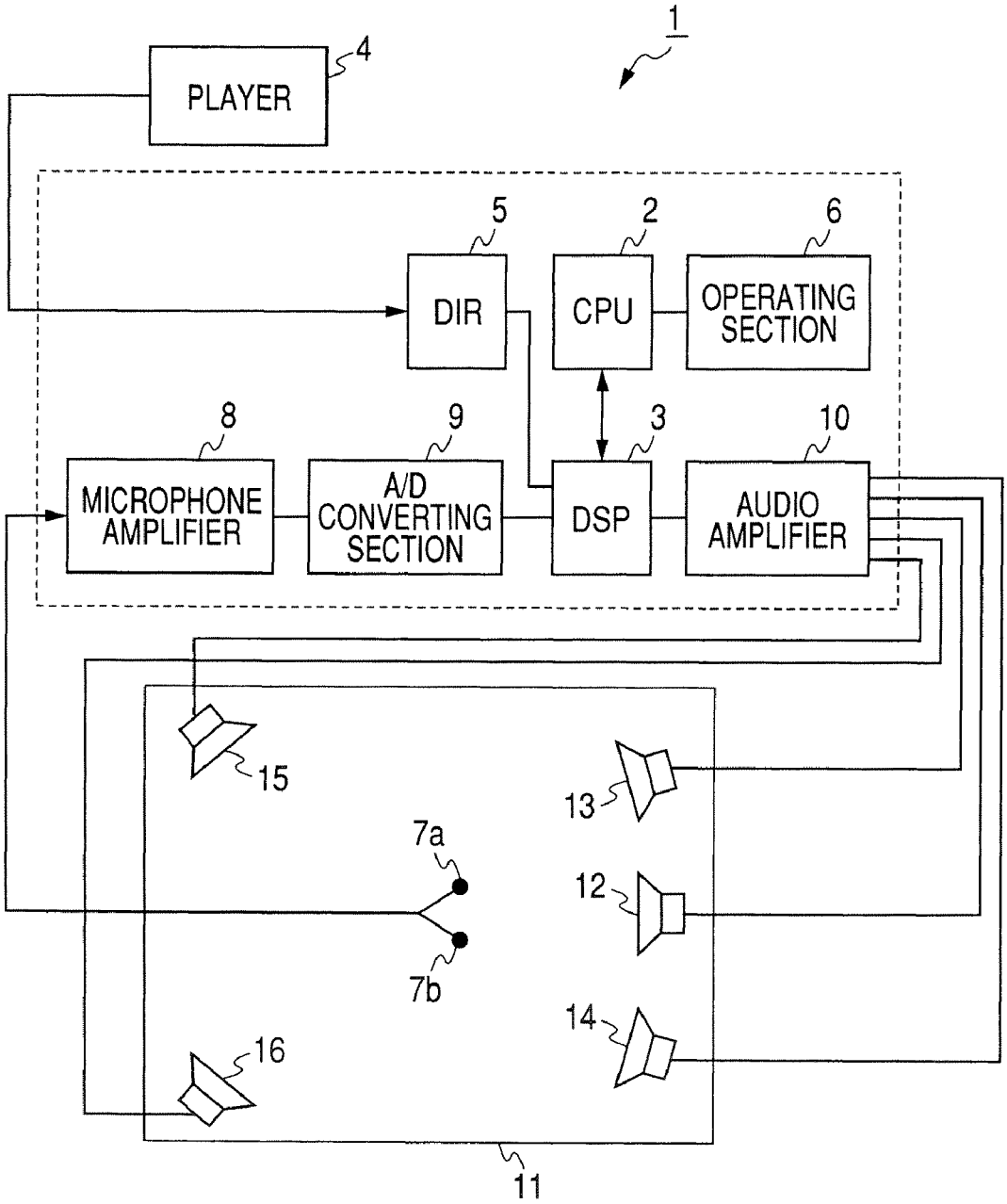
FIG. 1 is a block circuit diagram showing a construction of an acoustics correcting apparatus according to an embodiment of the invention.

As shown in FIG. 1, an acoustics correcting apparatus 1 according to an embodiment of the invention corrects and performs virtual sound image localization processing on the acoustics of multiple speakers 12 to 16 based on measurement data calculated from first and second collected signals obtained by collecting the sound output in response to the supply of a measurement signal for measurement to the multiple speakers 12 to 16 placed at arbitrary positions in an acoustic listening environment 11 by first and second collecting sections 7*a* and 7*b* spaced apart from each other at predetermined positions, that is, near an arbitrary hearing position.

The multiple speakers 12 to 16 are arbitrarily placed at predetermined positions within a room 11. The multiple speakers 12 to 16 are speakers for general audio reproduction and are connected to an audio amplifier 10 having a multichannel speaker output.

The acoustics correcting apparatus 1 includes, as shown in FIG. 1, a CPU 2 having a first processing section 21, based on measurement data such as acoustics and position information of the speakers, calculating a correction characteristic that corrects acoustics and calculating a virtual sound image characteristic coefficient for performing virtual sound image localization processing and a storage section 22 storing an acoustics measuring program causing to measure the measurement data based on the first and second collected signals, a virtual sound image localization processing program causing to perform virtual sound image localization processing on reproduce signals for the speakers based on the virtual sound image characteristic coefficient, and an acoustics correcting program correcting the acoustics of the reproduce signals for the speakers based on the correction characteristic and a DSP (Digital Signal Processor) 3 functioning as a second processing section reading the acoustics measurement program to supply a measurement signal for measurement to the multiple speakers 12 to 16, measuring the acoustics of the speakers from first and second collected signals by collecting the sound output from the multiple speakers that receive the supply of the measurement signal by the first and second collecting sections 7*a* and 7*b* and measuring the position information of the speakers.

The acoustics correcting apparatus 1 further includes a DIR (Digital Interface Receiver) 5 performing conversion processing for inputting a reproduce signal from a player 4 that reproduces voice information on a DVD or CD to the DSP 3, an operating section 6 functioning as a U/I (User Interface) for operating the CPU 2 by a user and the audio amplifier 10 outputting the measurement signal supplied from the DSP 3 and the reproduce signal processed in the DSP 3 to the speakers 12 to 16.

The acoustics correcting apparatus 1 further includes a pair of the first and second collecting sections 7*a* and 7*b* such as a nondirectional microphone that collects measurement sounds output from the speakers 12 to 16 which have received the supply of a measurement signal, a microphone amplifier 8 amplifying the first and second collected signals from the first and second collecting sections 7*a* and 7*b* and an A/D converting section 9 digitally converting collected signals amplified by the microphone amplifier 8.

The first and second collecting sections 7*a* and 7*b* are placed near a hearing position where a user actually hears and are here placed on both sides of the hearing position, that is, are spaced apart in the opposite direction by an equal distance, for example. In other words, the first and second collecting sections 7*a* and 7*b* are placed such that the hearing position can be located at the middle position of the positions where the first and second recording sections 7*a* and 7*b* are placed. Here, as described above, the first and second recording sections 7*a* and 7*b* are constructed to space apart on both sides of a hearing position by an equal distance. However, the invention is not limited thereto. the arrangement may be only required in which the hearing position can be located from the positions where the first and second collecting sections 7*a* and 7*b* are placed.

Figure 2:
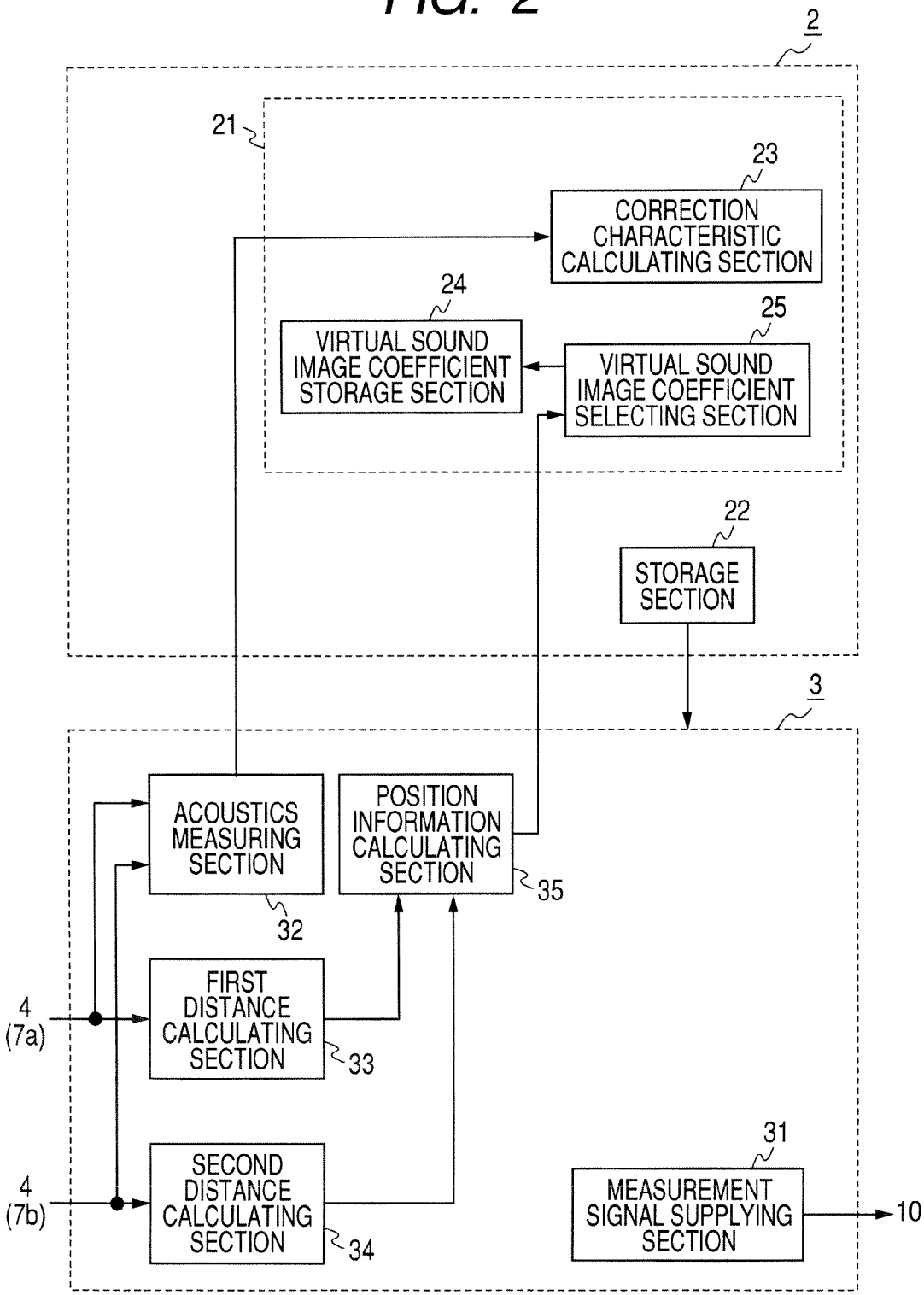
FIG. 2 shows a CPU and a DSP of the acoustics correcting apparatus according to the embodiment of the invention and is a block circuit diagram where an acoustics measuring program is started.

As shown in FIG. 2, the CPU 2 includes a storage section 22 storing the acoustics measuring program, virtual sound image localization processing program and acoustics correcting program, a correction characteristic calculating section 23, based on the acoustics measured by an acoustics measuring section 32, which will be described later, calculating a correction characteristic for correcting the acoustics to an optimum state, a virtual sound image coefficient memory section 24 storing multiple virtual sound image coefficients corresponding to possible different position information of speakers, and a virtual sound image coefficient selecting section 25 selecting an optimum virtual sound image coefficient from multiple virtual sound image coefficients based on the position information calculated by a position information calculating section 35, which will be described later.

Based on the acoustics measured by the acoustics measuring section 32, which will be described later, the correction characteristic calculating section 23 corrects the acoustics to an optimum state. That is, the correction characteristic calculating section 23 calculates a correction characteristic, which is information for correcting a reproduce signal sent from the player 4 to the speakers 12 to 16 through the DSP 3 and audio amplifier 10 such that the sound-pressure level, frequency response characteristic, delay (difference in reaching time) and so on when the sound output from the speakers reaches the hearing positions where the first and second collecting sections 7*a* and 7*b* are placed can have desired characteristics at the hearing positions. Then, when the player 4 is shifted to the play mode by the operating section 6, the correction characteristic calculating section 23 transfers the correction characteristic to an acoustics correcting section 42, which will be described later.

The virtual sound image coefficient memory section 24 stores multiple virtual sound image coefficients each for performing virtual sound image localization processing such that a hearer can feel in the same way as that resulting from the arrangement of the speakers 12 to 16 by an optimum distance and at an optimum angle when the speakers are placed in various arrangements by assuming various states that the speakers are actually placed. Though the virtual sound image coefficient memory section 24 is here constructed to store multiple virtual sound image coefficients in advance, the invention is not limited thereto. A virtual sound image coefficient may be constructed to allow to define and store by an operation by a user. Furthermore, a virtual sound image coefficient may be constructed to allow to add or update over a network or via a recording medium.

The virtual sound image coefficient selecting section 25 selects and calculates an optimum virtual sound image coefficient for actual positions of the speakers 12 to 16 from those in the virtual sound image coefficient memory section 24 in accordance with the position information such as the distance and angle of the speakers from the hearing position, which is calculated by the position information calculating section 35, which will be described later. Then, the virtual sound image coefficient selecting section 25 transfers the virtual sound image coefficient to a virtual sound image localization processing section 41, which will be described later. Though the virtual sound image coefficient selecting section 25 is constructed to select and calculate an optimum virtual sound image coefficient based on position information from multiple virtual sound image coefficients stored in the virtual sound image coefficient memory section 24 in advance here, the invention is not limited thereto. An optimum virtual sound image coefficient may be constructed to calculate by a virtual sound image coefficient calculating section calculating a virtual sound image coefficient from position information.

As shown in FIG. 2, the DSP 3 includes a measurement signal supplying section 31 supplying a measurement signal for measurement to the multiple speakers 12 to 16 when reading the acoustics measuring program from the storage section 22, an acoustics measuring section 32 measuring the acoustics of the speakers based on the first and second collecting singles obtained by the first and second collecting sections 7*a* and 7*b* and the measurement signals, a first distance calculating section 33 calculating distances from the speakers to the first collecting section 7*a* based on the first collected signal obtained by the first collecting section 7*a* and the measurement signals, a second distance calculating section 34 calculating a distance from the speakers to the second collecting section 7*b* based on the second collected signal obtained by the second collecting section 7*b* and the measurement signals, and the position information calculating section 35 calculating the position information of the speakers about the first and second collecting sections 7*a* and 7*b* based on the distances from the speakers to the first and second collecting sections 7*a* and 7*b*, which are calculated by the first and second distance calculating sections 33 and 34.

The measurement signal supplying section 31 supplies a TSP signal (Time Stretched Pulse) to the speakers 12 to 16 and thus causes the speakers to output measurement sounds for measurement.

The TSP signal is used in an acoustics measuring mode in which the acoustics measuring program is started in the DSP 3, and the acoustics of the space of the acoustic listening environment 11 is measured by the DSP 3 by using the TSP signal. The TSP signal here is a signal for measuring an impulse response and a signal resulting from the serial sweeping in a short period of time from a high value to a low value of the frequency having a sinusoidal wave. Since the use of the TSP signal distributes energy more on a time axis than that of the use of an impulse signal, a higher S/N ratio can be obtained with a fewer synchronizations. Furthermore, an inverse filter can be obtained more easily, and the conversion of the response of the TSP signal to an impulse response is easy since the convolution with the inverse filter may be only performed. Thus, the TSP signal is convenient for measurement.

A coefficient for flattening the frequency characteristic of the acoustic listening environment 11, for example, that is, the inverse filter coefficient is created by using a transmission coefficient of the room (the acoustic listening environment 11) having the speakers, which is obtained by calculating the impulse response frequency characteristic by using FFT (Fast Fourier Transform) and phase conversion on the TSP response time axis waveform data resulting from the output of the TSP signal from the speakers and collected by the first and second collecting sections 7*a* and 7*b*. A signal transmission time from the DSP 3 to the DSP 3 through the audio amplifier 10, speakers 12 to 16, first and second collecting sections 7*a* and 7*b*, microphone amplifier 8 and A/D converting section 9 can be obtained by calculating the impulse response time axis waveform data by using IFFT (Inverse Fast Fourier Transform) on the calculated frequency characteristic. Since the signal transmission time of the section from the DSP 3 to the speakers 12 to 16 through the audio amplifier 10 and the signal transmission time of the section from the first and second collecting sections 7*a* and 7*b* to the DSP 3 through the microphone amplifier 8 and A/D converting section 9 in the path are fixed in hardware, the transmission times of the two sections are fixed values. Thus, the difference between the obtained transmission time and the transmission times of the two sections is a transmission time between the speakers 12 to 16 and the first and second collecting sections 7*a* and 7*b*. The multiplication of the transmission time by the velocity of sound can calculate the distance from the speakers 12 to 16 to the first and second collecting sections 7*a* and 7*b*.

The acoustics measuring section 32 measures acoustics such as the presence of each of the speakers, the sizes (frequency bands) of the speakers, sound-pressure level of the outputs reaching from the speakers to the hearing position, the frequency response characteristics of the outputs reaching from the speakers to the hearing position and the reaching times (delays) of the outputs reaching from the speakers to the hearing position based on the first and second collected signals obtained by collecting the sounds output from the speakers 12 to 16 which have received the supply of the measurement signal, by the first and second collecting sections 7*a* and 7*b*. The acoustics measuring section 32 transfers the acoustics information to the correction characteristic calculating section 23 of the CPU 2.

The first distance calculating section 33 calculates the distance from the speakers 12 to 16 to the first collecting section 7*a* by calculating the signal transmission time based on the first collected signal received through the microphone amplifier 8 and A/D converting section 9 and the measurement signal supplied form the measurement signal supplying section 31 and transfers the information to the position information calculating section 35.

The second distance calculating section 34 calculates the distance from the speakers 12 to 16 to the second collecting section 7*b* by calculating the signal transmission time based on the second collected signal received through the microphone amplifier 8 and A/D converting section 9 and the measurement signal supplied form the measurement signal supplying section 31 and transfers the information to the position information calculating section 35.

The position information calculating section 35 calculates the angles to the positions where the speakers 12 to 16 about the first and second collecting sections 7*a* and 7*b* based on the distance from the speakers 12 to 16 to the position where the first collecting section 7*a* is placed, which is calculated by the first distance calculating section 33, and the distance from the speakers 12 to 16 to the position where the second collecting section 7*b* is placed, which is calculated by the second distance calculating section 34. In other words, the position information calculating section 35 calculates the position information of each of the speakers 12 to 16 by calculating the angles of the speakers about the first and second collecting sections 7*a* and 7*b* from the angles, the positions of the speakers 12 to 16 calculated by the first and second distance calculating sections 33 and 34, and the distances to the first and second collecting sections 7*a* and 7*b*. The position information calculating section 35 transfers the position information to the virtual sound image coefficient selecting section 25 of the CPU 2.

Now, the calculation of the angles of the speakers about the first ands second collecting section 7*a* and 7*b* by the position information calculating section 35 will be described with reference to FIGS. 3 and 4.

Figure 3:
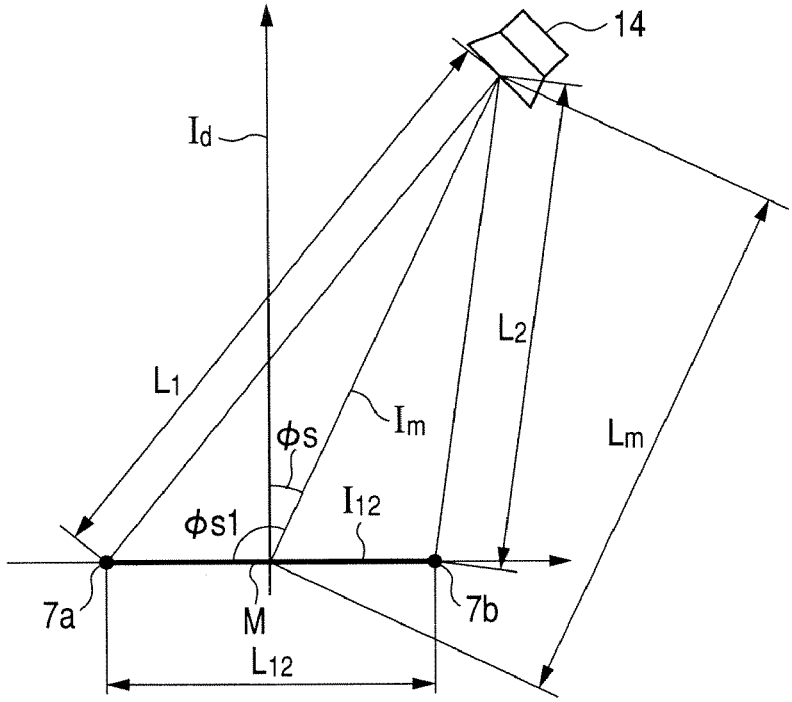
FIG. 3 is a diagram for describing the calculation of the angle of each speaker about first and second collecting sections in the acoustics correcting apparatus according to the embodiment of the invention.
Figure 4:
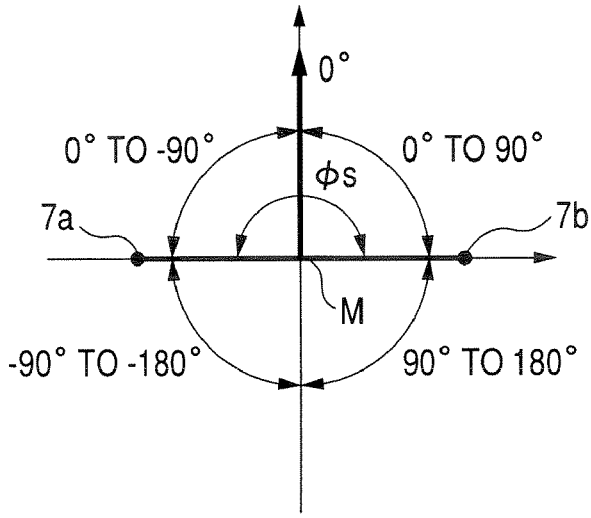
FIG. 4 is a diagram indicating the range of the angle $\phi s$ made by two equal lines of the segment connecting the middle point of the two collecting sections and one speaker and the segment connecting the two collecting sections in order to calculate the angle of each of speakers about the first and second collecting sections.

As shown in FIG. 3, the distances from one speaker 14 of the multiple speakers 12 to 16 to the first and second collecting sections 7*a* and 7*b*, which are calculated by the first and second distance calculating section 33 and 34, are L1 and L2, respectively. Here, based on "parallelogram theorem" and "cosine formula", the angle ϕs can be calculated which is created by the bisector ld of a segment 112 connecting the two collecting sections and the segment lm connecting the center (middle point) of the two collecting sections 7*a* and 7*b* and one of the speakers. Here, since the first and second collecting sections 7*a* and 7*b* are spaced apart by an equal distance on both sides of the hearing position as described above, the middle point M of the first and second collecting sections 7*a* and 7*b* is the hearing position.

In other words, based on "parallelogram theorem", the length Lm of the segment lm connecting the center of the fist and second collecting sections and one speaker may be calculated by:

$$Lm=((L12+L22)/2-(L12/2)2)1/2 \quad \text{[EQ1]}$$

Based on the value Lm and "cosine formula", the angle ϕs may be calculated by ϕs1, which is calculated by:

$$\phi s1=\mathrm{acos}(((L12/2)2+Lm2-L12)/(2\times L12/2\times Lm))\times(360/(2\pi)) \quad \text{[EQ2]}$$

where ϕs1 is the angle created by the segment lm and the segment 112.

In this case, because of the construction having two microphone elements of the first and second collecting sections 7*a* and 7*b*, whether the speaker is positioned in front of or at the back of the collecting point where the collecting sections are placed may not be determined. Thus, the range of ϕs1 is 0 to 180 degrees as shown in FIG. 4. Accordingly, the possible arrangement is specified from the order of measurement, and ϕs is calculated where the front of the positions where the collecting sections 7*a* and 7*b* are placed is handled as zero degree.

In this way, the position information calculating section 35 can calculate the position information including the angle and distance of the position where one speaker is placed about the first and second collecting sections 7*a* and 7*b* based on the distance from the one speaker to the first collecting section 7*a*, which is calculated by the first distance calculating section 33, and the distance from the one speaker to the second collecting section 7*b*, which is calculated by the second distance calculating section 34. Having described the calculation of the position information of the one speaker 14 here, the position information calculating section 35 can also calculate the position information for the other speakers.

Figure 5:
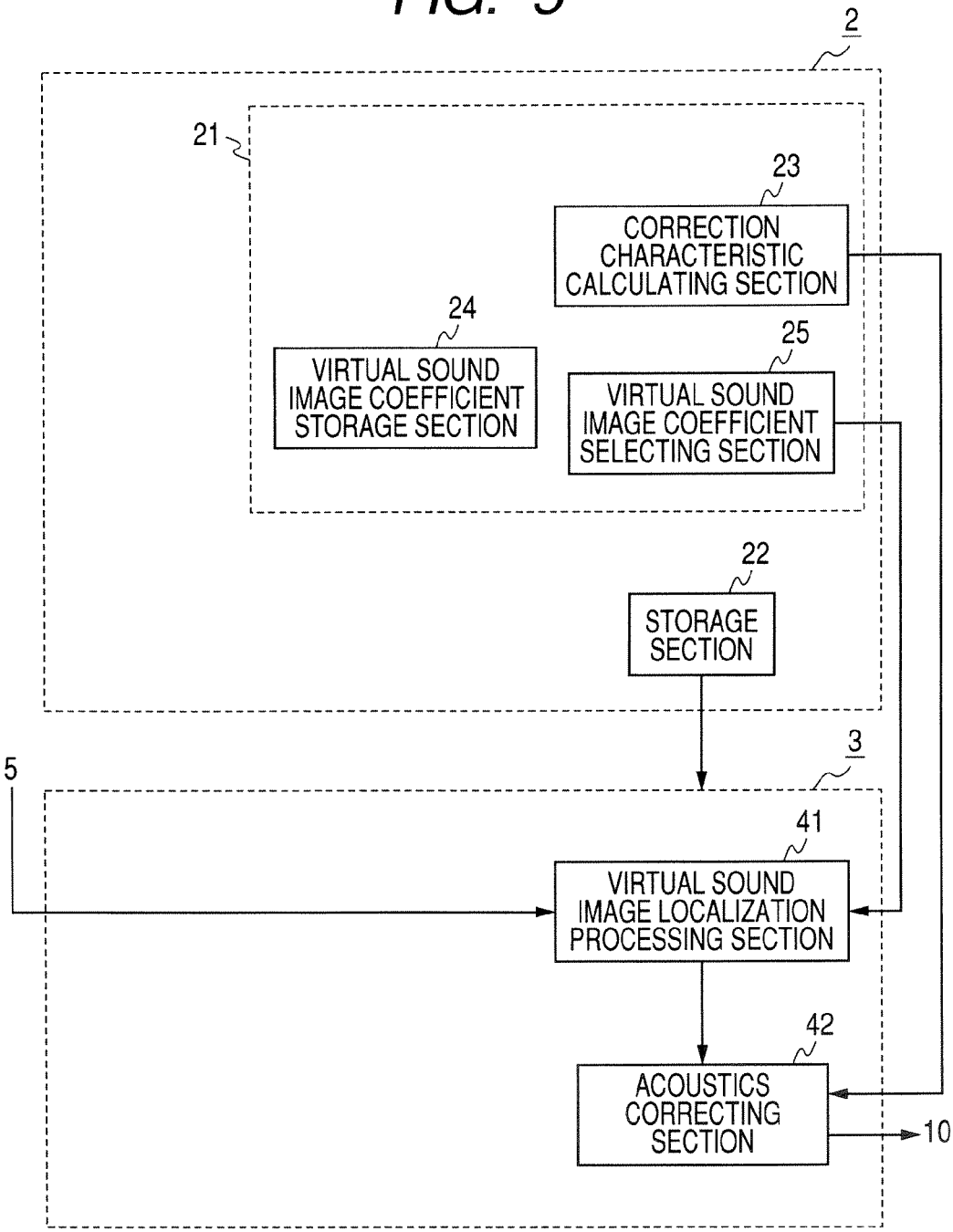
FIG. 5 shows a CPU and a DSP of the acoustics correcting apparatus according to the embodiment of the invention and is a block circuit diagram where a virtual sound image localization processing program and an acoustics correcting program are started.

As shown in FIG. 5, when reading the virtual sound image localization processing program and the acoustics correcting program from the storage section 22, the DSP 3 includes the virtual sound image localization processing section 41 performing virtual sound image localization processing on a reproduce signal for each speaker based on the virtual sound image coefficient selected by the virtual sound image coefficient selecting section 25 and the acoustics correcting section 42 performing acoustics correction on a reproduce signal for each speaker based on the correction characteristic calculated by the correction characteristic calculating section 23.

The virtual sound image localization processing section 41 transfers the result of the virtual sound image localization processing on the reproduce signal for each speaker received from the player 4 through the DIR 5 based on the virtual sound image coefficient calculated by the virtual sound image coefficient selecting section 25 to the acoustics correcting section 42.

The acoustics correcting section 42 performs acoustics correction the reproduce signals for the speakers, which have undergone the virtual sound image localization processing in the virtual sound image localization processing section 41 based on the correction characteristic calculated by the correction characteristic calculating section 23 to an optimum state matching with the acoustic listening environment 11 where the measurement is performed and transfers the result to the speakers 12 to 16 through the audio amplifier 10.

The acoustics correcting apparatus 1 having the construction as described above can automatically perform optimum sound image localization processing by using the virtual sound image coefficient selected by the virtual sound image coefficient selecting section 25 based on the position information of each speaker, which is calculated by the position information calculating section 35. The acoustics correcting apparatus 1 further can reproduce voice information with optimum acoustics by performing desired acoustics correction by using the correction characteristic which is calculated by the correction characteristic calculating section 23 based on the acoustics of the speakers measured by the acoustics measuring section 32.

Now, the virtual sound image localization processing by the virtual sound image localization processing section 41 of the acoustics correcting apparatus 1 will be described.

The virtual sound image localization processing by the virtual sound image localization processing section 41 is processing for making a listener to feel that even sound output from the speakers 12 to 16 placed at arbitrary positions has a sound image not at the real speaker positions where the speakers are actually placed but at a different position from the real speaker positions or for preventing a listener from feeling that sound is output from the real speakers.

Figure 6:
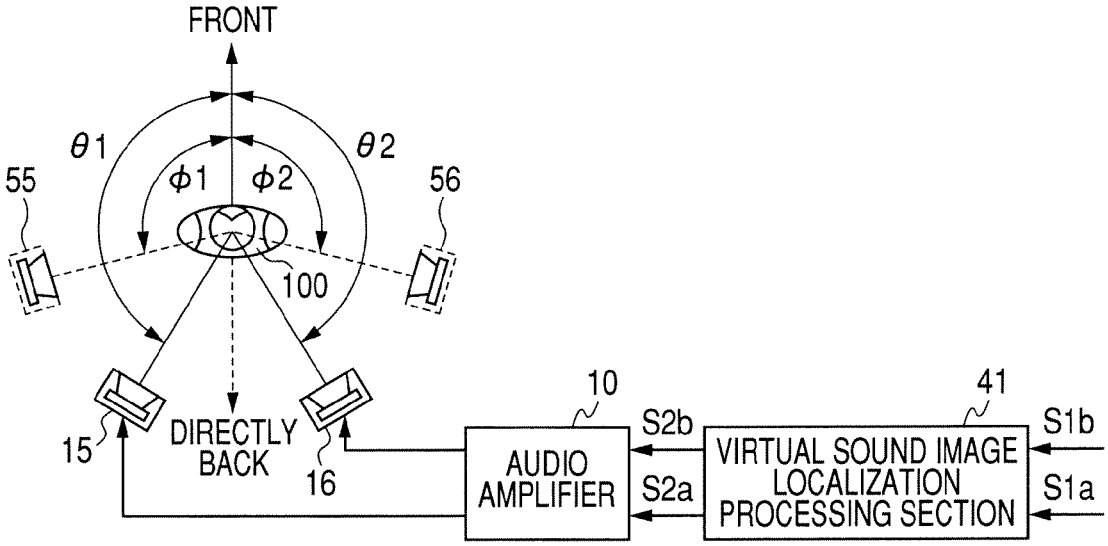
FIG. 6 is a diagram for describing an example of the virtual sound image localization processing of the acoustics correcting apparatus according to an embodiment of the invention.

Here, in the description of an example of the virtual sound image localization processing, as shown in FIG. 6, virtual speaker positions 55 and 56 corresponding to the speakers 15 and 16 (which will be called "rear speakers" hereinafter) placed on the rear side are defined, and when sound is output from the rear speakers 15 and 16, a listener is audible as that there is a sound image at the virtual speaker positions 55 and 56.

Furthermore, as shown in FIG. 6, the virtual speaker positions 55 and 56 are defined at the position where the opening angle $\phi 1$, which is created by the front direction of a listener 100 and the direction connecting from the listener 100 to the virtual speaker position 55, with reference to the listener 100 and the opening angle $\phi 2$, which is created by the front direction of the listener 100 and the direction connecting from the listener 100 to the virtual speaker position 56, with reference to the listener 100 are both smaller than opening angles $\theta 1$ and $\theta 2$ on a horizontal plane from the front of the luster 100 to the rear speakers 15 and 16.

In this way, the virtual speaker positions 55 and 56 are defined in the direction that the opening angles $\phi 1$ and $\phi 2$ from the front of the listener 100 to the virtual speaker positions 55 and 56 with reference to the listener 100 can be closer to the recommended value of the opening angle. Here, the recommended value of the opening angle of a rear speaker is generally known as in the order of 110 degrees.

Thus, the placement of the rear speakers 15 and 16 and the virtual speaker positions 55 and 56 is defined to satisfy:

$$\phi 1<\theta 1 \quad \text{[EQ3]}$$

and $$\phi 2<\theta 2 \quad \text{[EQ4]}$$

Then, the virtual sound image localization processing by the virtual sound image localization processing section 41 is performed based on the acoustic transfer function from the virtual speaker positions 55 and 56 to the ears of the listeners 100 when sound is output from the virtual speaker positions 55 and 56 and on the acoustic transfer function from the rear speakers 15 and 16 to the ears of the listener 100 when sound is output from the rear speakers 15 and 16. Here, the acoustic transfer function is determined by the virtual sound image coefficient selected by the virtual sound image coefficient selecting section 25.

Next, with reference to FIGS. 7 and 8, the acoustic transfer function for virtual sound image localization processing will be described.

Figure 7:
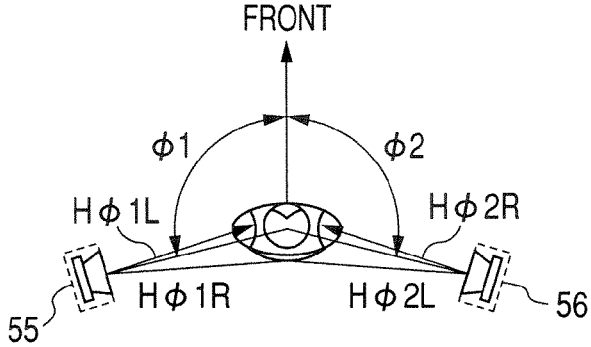
FIG. 7 is a diagram showing example positions of virtual speakers in the virtual sound image localization processing section.

The virtual sound image localization processing may require, as shown in FIG. 7, an acoustic transfer function $H\phi 1L$ to the left ear of the listener 100 and an acoustic transfer function $H\phi 1R$ to the right ear of the listener 100 when sound is output from the virtual speaker position 55 at the opening angle $\phi 1$ and an acoustic transfer function $H\phi 2R$ to the right ear of the listener 100 and an acoustic transfer function $H\phi 2L$ to the left ear of the listener 100 when sound is output from the virtual speaker position 56 at the opening angle $\phi 2$.

Figure 8:
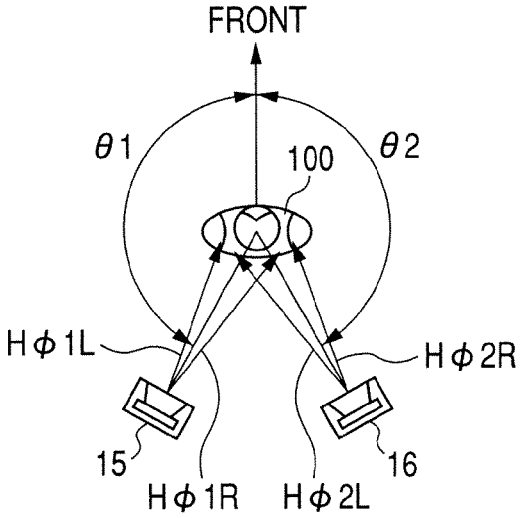
FIG. 8 is a diagram showing example positions of real speakers in the virtual sound image localization processing section.

Furthermore, as described later, in order to compensate the cross talk when sound is output from the rear speakers 15 and 16, the virtual sound image localization processing may require an acoustic transfer function $H\theta 1L$ to the left ear of the listener 100 and an acoustic transfer function $H\theta 1R$ to the right ear of the listener 100 when sound is output from the rear speaker 15 placed to have the opening angle $\theta 1$ and an acoustic transfer function $H\theta 2R$ to the right ear of the listener 100 and an acoustic transfer function $H\theta 2L$ to the left ear of the listener 100 when sound is output from the rear speaker 16 placed to have the opening angle $\theta 2$, as shown in FIG. 8.

These acoustic transfer functions can be obtained by placing speakers at the positions of the virtual speaker positions 55 and 56 shown in FIG. 7 and the rear speakers 15 and 16 shown in FIG. 8, outputting an impulse sound from the speakers placed at the positions and measuring the impulse responses at the left and right ears of the listener 100. In other words, the impulse responses measured at the ears of the luster are acoustic transfer functions from the speaker positions where the impulse sound is output to the ears of the listener 100.

Multiple virtual sound image coefficient for defining the acoustic transfer functions, which may be required in this way, are stored in the virtual sound image coefficient memory section 24, and the acoustic transfer function are derived from the virtual sound image coefficient selected by the virtual sound image coefficient selecting section 25 from them, and the virtual sound image localization processing is performed based on the acoustic transfer function by the virtual sound image localization processing section 41.

Figure 9:
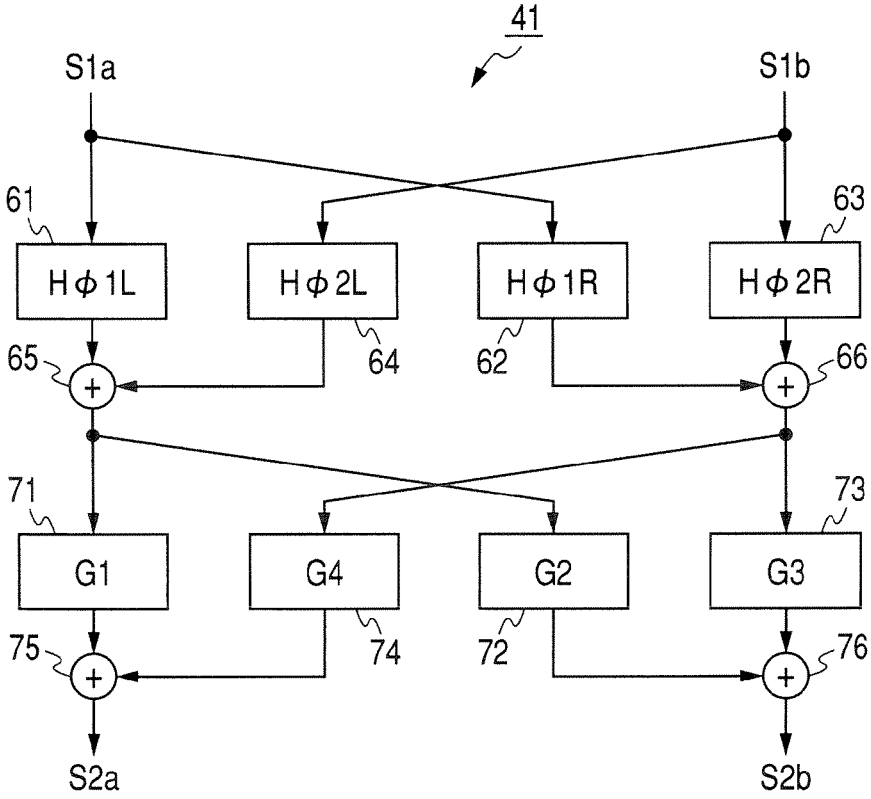
FIG. 9 is a block circuit diagram showing a virtual sound image localization processing section that executes an example of the virtual sound image localization processing.

Next, FIG. 9 shows a block diagram for describing the virtual sound image localization processing section 41. As shown in FIG. 9, the virtual sound image localization processing section 41 includes filters 61, 62, 63 and 64 to be used for so-called binauralization processing, filters 71, 72, 73 and 74 to be used for so-called cross-talk compensation processing for compensating spatial acoustic cross talk, which occurs when reproduced sound is output from the rear speakers 15 and 16, and adding circuits 65, 66, 75 and 76.

As shown in FIG. 9, the filters 61, 62, 63 and 64 use, as the filter coefficients (virtual sound image coefficients) the acoustic transfer functions Hϕ1L and Hϕ1R and Hϕ2R and Hϕ2L from the virtual speaker positions 55 and 56 to the left and right ears of the listener 100, which have described with reference to FIG. 7. In other words, the virtual sound image coefficients functioning as the filter coefficients are selected by the virtual sound image coefficient selecting section 25 in this case.

Figures 10, 11:
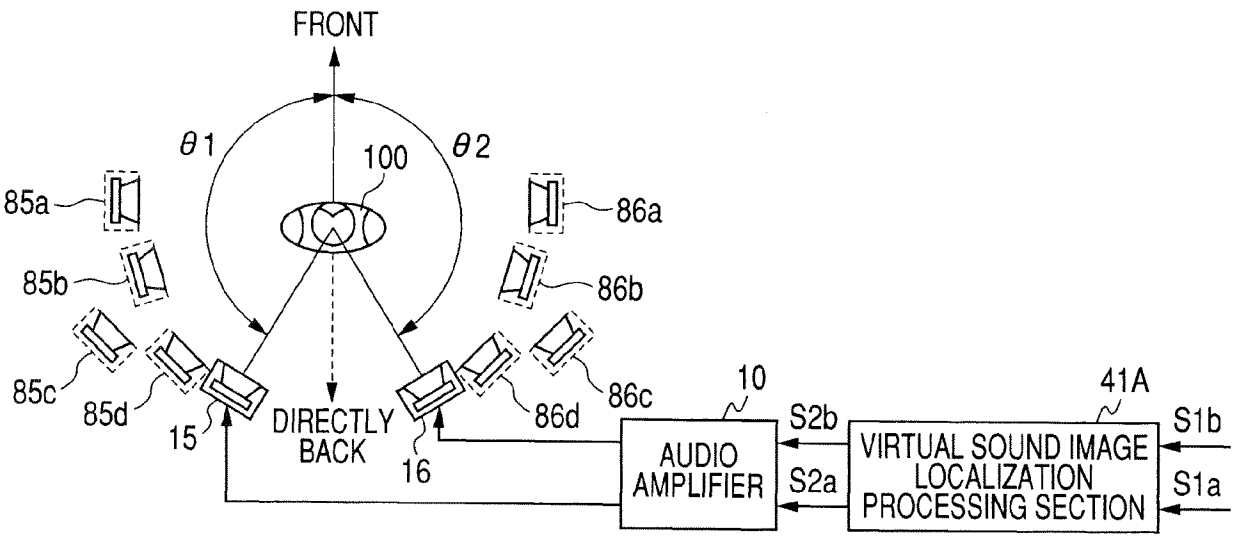
FIG. 10 is a diagram showing filter coefficients of the virtual sound image localization processing section that executes an example of the virtual sound image localization processing.
FIG. 11 is a diagram for describing another example of the virtual sound image localization processing of the acoustics correcting apparatus according to an embodiment of the invention.

As shown in FIG. 10, the filters 71, 72, 73 and 74 use, as the filter coefficients, filter coefficients G1, G2, G3 and G4 obtained based on the acoustic transfer coefficients Hθ1L and Hθ1R and Hθ2R and Hθ2L from the rear speakers 15 and 16 to the left and right ears of the listener 100, which have described with reference to FIG. 8.

Then, the sound signal S1*a* for the left rear speaker reproduced by the player 4 and received by the virtual sound image localization processing section 41 through the DIR 5 is supplied to the filters 61 and 62 of the virtual sound image localization processing section 41. The sound signal S1*b* for the right rear speaker is supplied to the filters 63 and 64 of the virtual sound image localization processing section 41.

The filters 61 and 62 convert the sound signal S1*a* to be supplied to the left rear speaker 15 based on the filter coefficients Hϕ1L and Hϕ1R such that the sound output from the left rear speaker 15 is audible as having the sound image at the virtual speaker position 55 or the sound image on the side of the virtual speaker position 55.

The filters 63 and 64 also convert the sound signal S1*b* to be supplied to the right rear speaker 16 based on the filter coefficients Hϕ2R and Hϕ2L such that the sound output from the right rear speaker 16 is audible as having the sound image at the virtual speaker position 56 or the sound image on the side of the virtual speaker position 56.

Then, the sound signal processed by the filters 61 and 64 and to be heard by the left ear of the listener 100 is supplied to the adding circuit 65. Also, the sound signal processed by the filters 62 and 63 and to be heard by the left ear of the listener 100 is supplied to the adding circuit 66.

The sound signal processed by the adding circuit 65 is supplied to the filters 71 and 72 while the sound single processed by the adding circuit 66 is supplied to the filters 73 and 74.

The filters 71, 72, 73 and 74 performs processing of canceling cross talk in accordance with the filter coefficients G1, G2, G3 and G4 calculated based on the acoustic transfer functions from the rear speakers 15 and 16 to the ears of the listener 100. Then, the sound signal processed by the filters 71 and 74 is supplied to the adding circuit 75 while the sound signal processed by the filters 72 and 73 is supplied to the adding circuit 76.

The adding circuit 75 outputs a sound signal S2*a*, which is a sound signal to be supplied to the left rear speaker 15 and is audible as having the sound image on the virtual speaker position 55 side when it is output from the left rear speaker 15. The adding circuit 76 outputs a sound signal S2*b*, which is a sound signal to be supplied to the right rear speaker 16 and is audible as having the sound image on the virtual speaker position 56 side when it is output from the right rear speaker 16.

Thus, the listener is audible the sound output in a way that there is the sound image at the virtual speaker positions 55 and 56 or there is the sound image on the virtual speaker positions 55 and 56 sides even when sound signals for rear speakers are output from the rear speakers 15 and 16.

Hence, the unpreferable existence such as the stickiness of the sound source that the rear speaker has can be resolved, and the sound output from the rear speaker becomes audible as natural sound. Therefore, the atmosphere and reality demanded in the sound output from the rear speaker can be improved.

Having described that the corresponding virtual speakers 55 and 56 are defined for the two rear speakers 15 and 16 one by one, the invention is not limited thereto. Multiple virtual speakers may be defined for each of the two rear speakers 15 and 16. In other words, a virtual sound image coefficient for defining multiple virtual speakers may be calculated by the virtual sound image coefficient selecting section 25.

Next, with reference to FIG. 11, another example of the virtual sound image localization processing will be described which more improves the atmosphere of the rear (surround) sound field by defining multiple virtual speaker positions for each of the two rear speakers 15 and 16.

As shown in FIG. 11, this example also has the same construction as that of the example above except that multiple virtual speakers 85*a*, 85*b*, 85*c* and 85*d* and multiple virtual speakers 86*a*, 86*b*, 86*c* and 86*d* are defined for the rear speakers 15 and 16.

Thus, the definition of multiple virtual speaker positions differentiates the coefficients (virtual sound image coefficients) for binauralization processing in a virtual sound image localization processing section 41A from the example above. In other words, multiple virtual speaker positions may be allowed to define by using the virtual sound image coefficients selected by the virtual sound image coefficient selecting section 25 as the filter coefficients as described below. Though the example in which four virtual speakers are to be defined will be described below, the method for the virtual sound image localization processing may be switched by selecting the number and positions of the virtual speakers by the operating section 6.

In this example, since, as shown in FIG. 11, each four virtual speaker positions 85*a* to 85*d* and 86*a* to 86*d* are defined for the rear speakers 15 and 16, respectively, the coefficients of the filters for binauralization processing is determined in consideration of multiple acoustic transfer functions from each of the multiple virtual speaker positions to the ears of a listener.

Figures 12, 13:
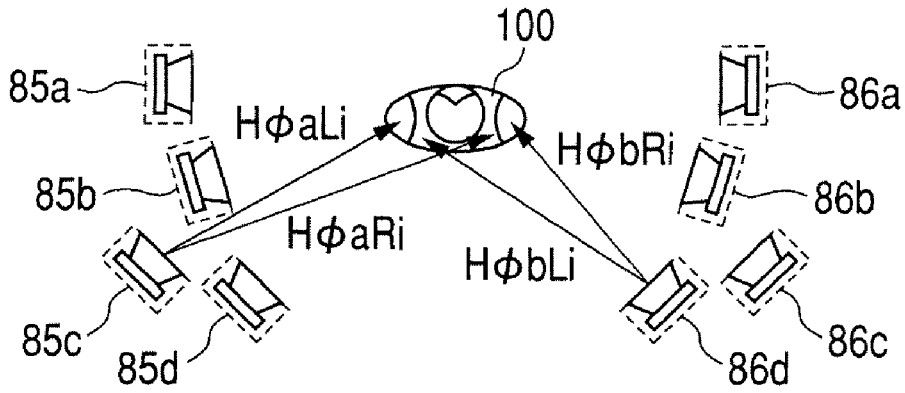
FIG. 12 is a diagram showing other example positions of virtual speakers in the virtual sound image localization processing section.
FIG. 13 is a diagram showing filter coefficients of the virtual sound image localization processing section that executes another example of the virtual sound image localization processing.

In this case, as shown in FIG. 12, the acoustic transfer functions from the virtual speaker positions to the left and right ears of the listener 100 can be obtained by placing speakers at the positions of the virtual speaker positions, outputting an impulse sound and measuring the impulse responses at the left and right ears of the listener 100.

Then, the addition of the acoustic transfer functions from the multiple virtual speaker positions to the ear of the listener 100 results in the acoustic transfer function to the left and right ears of the listener 100 when multiple virtual speaker positions are defined in this way.

In other words, the acoustic transfer function H1 to the left ear and the acoustic transfer function H2 to the right ear of the listener 100 from the virtual speaker positions 85*a* to 85*d* on the left side of the listener 100 can be obtained by:

$$H1=H\phi aL1+H\phi aL2+H\phi aL3+H\phi aL4 \quad \text{[EQ5]; and}$$

$$H2=H\phi aR1+H\phi aR2+H\phi aR3+H\phi aR4 \quad \text{[EQ6]}$$

In the same manner, the acoustic transfer function H3 to the left ear and the acoustic transfer function H4 to the right ear of the listener 100 from the virtual speaker positions 86*a* to 86*d* on the right side of the listener 100 can be obtained by:

$$H3=H\phi bL1+H\phi bL2+H+bL3+H\phi bL4 \quad \text{[EQ7]; and}$$

$$H4=H\phi bL1+H\phi bL2+H+bL3+H\phi bL4 \quad \text{[EQ8]}$$

Therefore, the acoustic transfer functions H1, H2, H3 and H4 at the left and right ears of the listener 100 in this case can be obtained as shown in FIG. 13 where the numerical value indicating the suffixes after the HϕaL, HϕaR, HϕbL and HϕbR is i.

Figure 14:
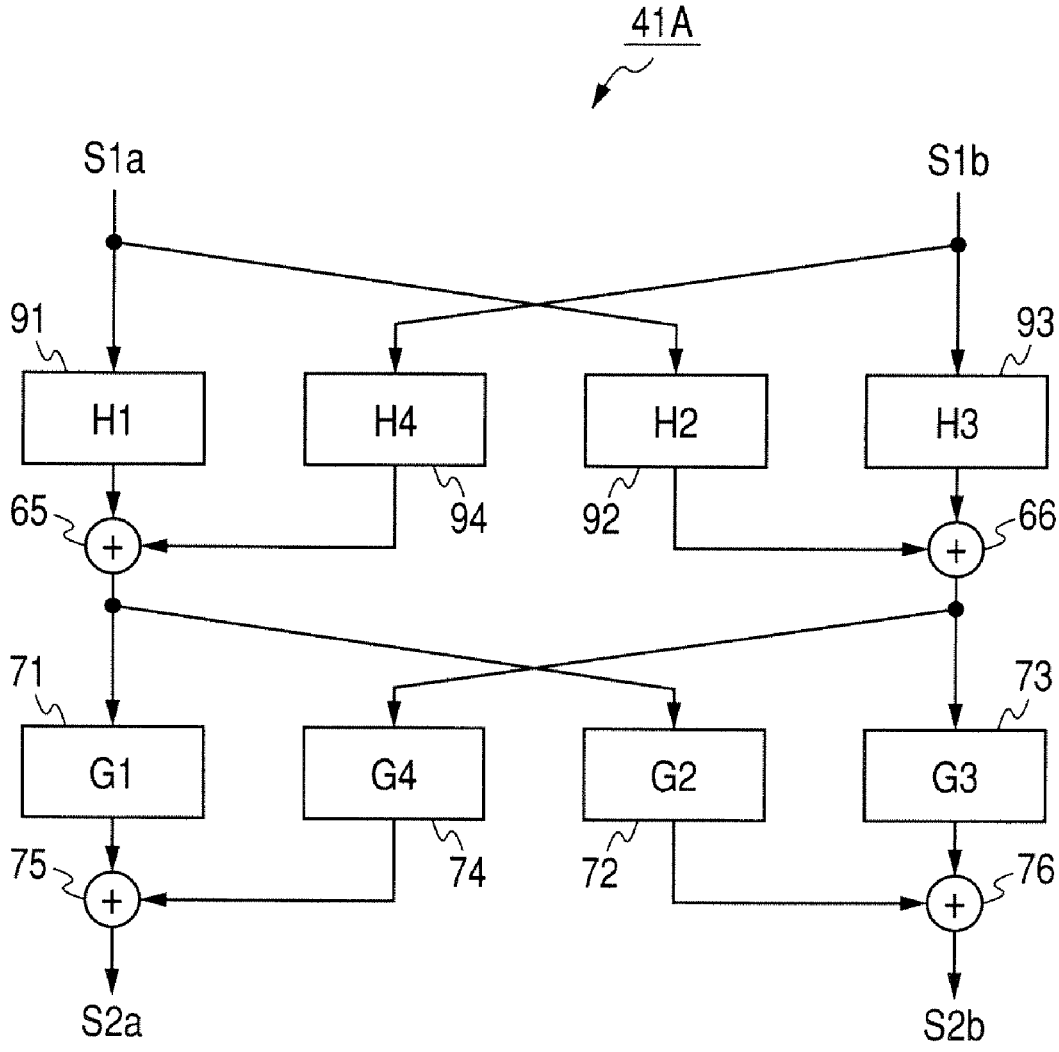
FIG. 14 is a block circuit diagram showing the virtual sound image localization processing section that executes another example of the virtual sound image localization processing.

Then, in the case of this example, as shown in FIG. 14, the virtual sound image localization processing section 41A includes filters 91, 92, 93 and 94 using the acoustic transfer functions H1, H2, H3 and H4 obtained in accordance with the multiple virtual speaker positions 85*a* to 85*d* and 86*a* to 86*d* as the filter coefficients.

In this case, the filter 91 uses the acoustic transfer function H1 from the left virtual speaker positions 85*a*, 85*b*, 85*c* and 85*d* of the listener 100 shown in FIG. 12 to the left ear of the listener 100 as the filter coefficient. The filter 92 uses the acoustic transfer function H2 from the left virtual speaker positions 85*a*, 85*b*, 85*c* and 85*d* of the listener 100 shown in FIG. 12 to the right ear of the listener 100 as the filter coefficient.

In the same manner, the filter 93 uses the acoustic transfer function H3 from the right virtual speaker positions 86*a*, 86*b*, 86*c* and 86*d* of the listener 100 shown in FIG. 12 to the right ear of the listener 100 as the filter coefficient. The filter 94 uses the acoustic transfer function H4 from the right virtual speaker positions 86*a*, 86*b*, 86*c* and 86*d* of the listener 100 shown in FIG. 12 to the left ear of the listener 100 as the filter coefficient.

In this way, by defining many virtual speaker positions, the sound field can get closer to the sound field upon mixing of the sound signals (source), and more natural sound field representation can be obtained. Furthermore, the atmosphere of the surround sound field can be more improved.

Though each four virtual speaker positions (virtual sound images) are defined on the left and right at the back of the listener 100 as shown in FIG. 11 in this example, the invention is not limited thereto. Multiple virtual speakers such as each two, three, five or six speakers on the left and right may be defined to define the virtual sound images.

Though the virtual speakers (virtual sound images) are defined within the opening angles θ1 and θ2, which are angles created by the front direction of the listener 100 and the directions connecting the listener 100 and the rear speaker 15 and 16 with reference to the listener 100, the invention is not limited thereto. For example, the virtual speaker position may be defined outside of a real speaker, or multiple virtual speaker positions may be defined inside and outside of a real speaker.

Furthermore, the method for the virtual sound image localization processing may be switchable. In other words, virtual sound image coefficients to allow multiple patterns of virtual speakers, that is, multiple types of number and arrangement of virtual speakers for each possible speaker arrangement may be prepared as the virtual sound image coefficients stored in the virtual sound image coefficient memory section 24. Then, the real arrangement may be automatically read by the position information calculating section 35, and the desired number and arrangement of virtual speakers may be selected by an operation on the operating section 6, for example.

In this way, the rear speaker positions where the rear speakers 15 and 16 may be at arbitrary positions at the back of the listener 100. Apparently, the virtual speaker positions may be defined arbitrarily.

In this way, the virtual sound image localization processing sections 41 and 41A perform virtual sound image localization processing on reproduce signals based on the position information calculated by the position information calculating section 35 from multiple virtual sound image coefficients stored in the virtual sound image coefficient memory section 24 and by using the virtual sound image coefficients automatically selected by the virtual sound image coefficient selecting section 25, which makes a listener feel the sound image at a desired position or prevents a listener from feeling that sound is output from an actually placed speaker. In other words, the similar sense of realism to that of optimum speaker arrangement can be obtained even when speakers are placed in an indoor environment where the optimum speaker arrangement is difficult.

Figure 15:
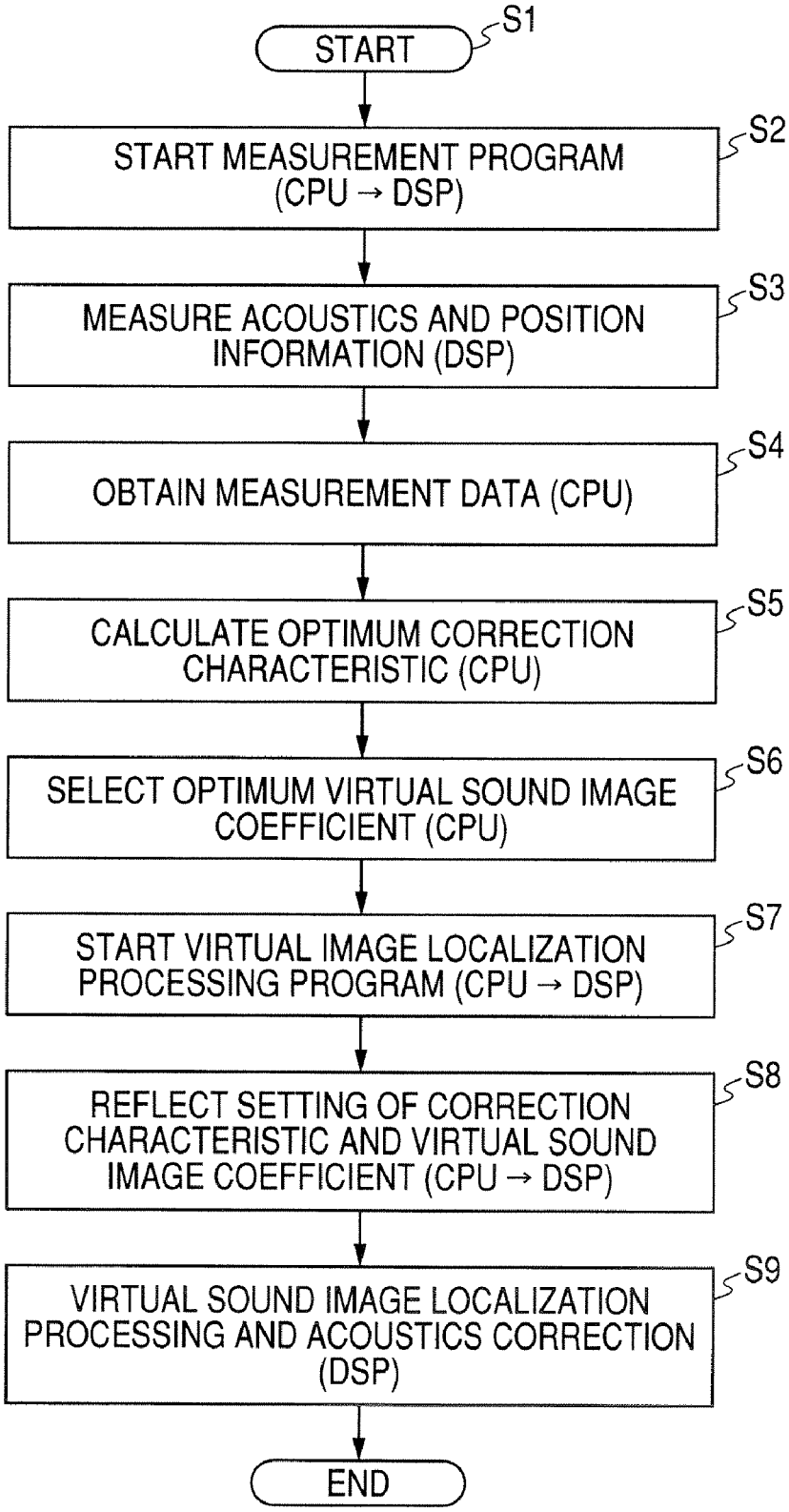
FIG. 15 is a flowchart for describing steps of measuring the acoustics of speakers placed in an arbitrary indoor environment, defining a virtual sound image coefficient, defining the correction of the acoustics, performing virtual sound image localization processing and correcting the acoustics by the acoustics correcting apparatus according to an embodiment of the invention.

Next, steps of measuring acoustics of speakers placed in an arbitrary indoor environment, defining virtual sound image coefficients, defining acoustic correction characteristic, performing virtual sound image localization processing and correcting acoustics by the acoustic correcting apparatus 1 will be described with reference to FIG. 15.

First of all, first and second collecting sections 7*a* and 7*b* are placed near a hearing position M where sound output from the speakers 12 to 16 placed at arbitrary positions is heard. In this case, the first and second collecting sections 7*a* and 7*b* are spaced apart by an equal distance on both sides of the hearing position (S1) as described above.

When the acoustics measuring mode is operated to start from the operating section 6, the acoustics measuring program is read from the storage section of the CPU 2 to the DSP 3, and the acoustics measuring program is started in the DSP 3 (S2).

With the acoustics measuring program active, the DSP 3 measures acoustics (sound field) and measurement data such as position information of the speakers (S3).

Figure 16:
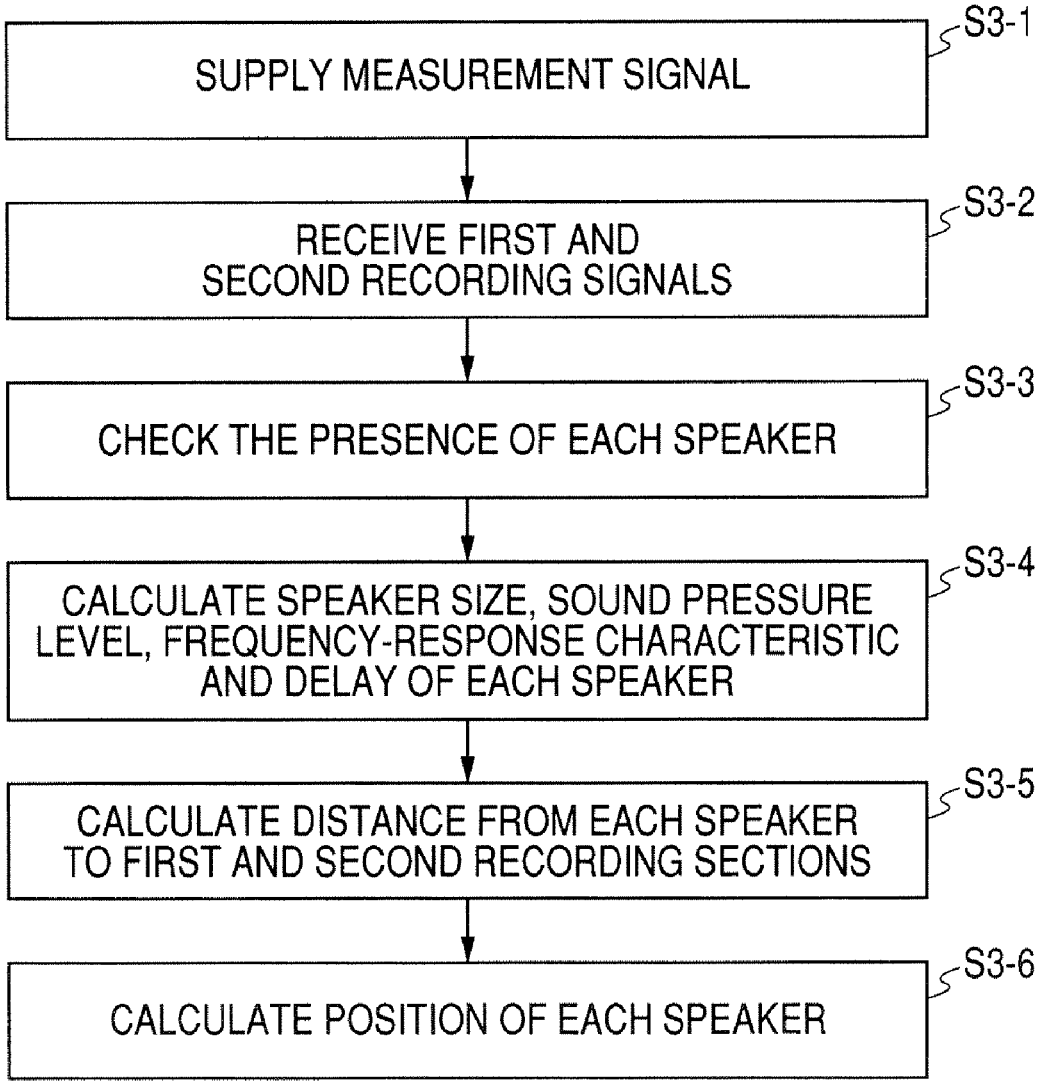
FIG. 16 is a flowchart for describing in more detail the steps of measuring acoustics among the steps shown in FIG. 15.

Here, the measurement of acoustics and position information will be described in detail with reference to FIG. 16.

First, as shown in FIG. 2, a measurement signal is supplied from the measurement signal supplying section 31 of the DSP 3 to the speakers through the audio amplifier 10 (S3-1). The speakers 12 to 16 that have received the supply of the measurement signal output sound for measurement. The sound output from the speakers is collected by the first and second collecting sections 7*a* and 7*b* placed at predetermined positions, and collected signals are obtained.

The acoustics measuring section 32, first distance calculating section 33 and second distance calculating section 34 of the DSP 3 receive collected signals from the first and second collecting sections 7*a* and 7*b* through the microphone amplifier 8 and A/D converting section 9 (S3-2).

The acoustics measuring section 32 that has received the first and second collected signals checks the presence of the speakers (S3-3). More specifically, the acoustics measuring section 32 checks whether the connection to the speakers is implemented properly for proper output or not.

The acoustics measuring section 32 that has received the first and second collected signals calculates acoustics such as the speaker sizes (frequency bands) of the speakers, the sound-pressure levels of measurement sound reaching from the speakers 12 to 16 to the hearing position (first and second collecting sections 7*a* and 7*b*), the frequency response characteristic of the measurement sound reaching from the speakers to the hearing position and a delay (reaching time) of the measurement sound reaching from the speakers to the hearing position (S3-4).

The first distance calculating section 33 that has received the first collected signal calculates the distance form the speakers to the first collecting section. The second distance calculating section 34 that has received the second collected signal calculates the distance from the speakers to the second collecting section (S3-5). The distances calculated by the first and second distance calculating sections 33 and 34 are transferred to the position information calculating section 35.

The position information calculating section 35 calculates, as described above, the angles of the speakers based on the distances calculated by the first and second distance calculating sections 33 and 34, that is, calculates position information including the distances and angles of the speakers about the positions where the first and second collecting sections 7*a* and 7*b* (S3-6).

As in S3-1 to S3-6 above, the DSP 3 measures acoustics and position information.

Next, the CPU 2 obtains measurement data including the acoustics measured and the position information calculated by the DSP 3 (S4).

The correction characteristic calculating section 23 of the CPU 2 calculates an optimum correction characteristic based on the acoustics measured by the acoustics measuring section 32 of the DSP 3 (S5).

Based on the position information calculated by the position information calculating section 35 of the DSP 3, the sound image coefficient selecting section 25 of the CPU 2 selects an optimum virtual sound image coefficient corresponding to the position information from multiple virtual sound image coefficients stored in the virtual sound image coefficient memory section 24 (S6).

Next, when an information signal reading mode is operated to start from the operating section 6, the acoustics correcting program and virtual sound image localization processing program are read by the DSP 3 from the storage section of the CPU 2, and the acoustics correcting program and virtual sound image localization processing program are started by the DSP 3 (S7).

Then, the correction characteristic calculated by the correction characteristic calculating section 23 of the CPU 2 is supplied to the acoustics correcting section 42. The virtual sound image coefficient selected by the sound image coefficient selecting section 25 of the CPU 2 is supplied to the virtual sound image localization processing section 41. The correction characteristic is defined in the acoustics correcting section 42 of the DSP 3, and the virtual sound image coefficient is reflected in the virtual sound image localization processing section 41 (S8).

The virtual sound image localization processing section 41 of the DSP 3 performs virtual sound image localization processing on reproduce signals for the speakers, which are supplied from the player 4 through the DIR 5, and the acoustics correcting section 42 corrects the acoustics of the reproduce signals for the speakers that have undergone the virtual sound image localization processing (S9).

In this way, the acoustics correcting apparatus 1 supplies the reproduce signals, that have undergone the virtual sound image localization processing and acoustics correction, to the speakers and causes the speakers to output sound information.

The acoustics correcting apparatus 1 according to an embodiment of the invention can obtain position information of the speakers from the first and second distance calculating sections 33 and 34 and the position information calculating section 35 based on the first and second collected signals obtained by the first and second collecting sections 7*a* and 7*b* and the measurement signals, and the virtual sound image coefficient selecting section 25 selects virtual sound image coefficients based on the position information. This construction can eliminate the necessity of the operation for defining a position where a speaker is placed by a listener and allows the automatic definition of an optimum virtual sound image coefficient. The acoustics correcting apparatus 1 according to an embodiment of the invention allows desired acoustics correction and can reproduce sound information with optimum acoustics by using the correction characteristic calculated by the correction characteristic calculating section 23 based on the acoustics of the speakers, which are measured by the acoustics measuring section 32.

Thus, the acoustics correcting apparatus 1 according to an embodiment of the invention can eliminate the necessity of an operation for defining the position where a speaker is placed by a listener, allows the automatic definition of an optimum virtual sound image coefficient, corrects the acoustics of an audio system including multiple speakers, can perform virtual sound image localization processing, can provide the similar sense of realism to that of the optimum speaker arrangement and can provide higher quality sense of realism as provided by the arrangement of many speakers.

Furthermore, the acoustics correcting apparatus 1 according to an embodiment of the invention allows the switching and output of desired sense of realism by defining multiple positions of virtual sound images or defining a virtual sound image at a desired position by not only deriving a virtual sound image coefficient but also switching the method for the virtual sound image localization processing when the virtual sound image coefficient is selected by the virtual sound image coefficient selecting section based on the position information.

It should be understood by those skilled in the art that various modifications, combinations, sub-combinations and alterations may occur depending on design requirements and other factors insofar as they are within the scope of the appended claims or the equivalents thereof.

What is claimed is:

1. An acoustics correcting apparatus, comprising:

a measurement signal supplying section supplying a time stretched pulse (TSP) measurement signal for measurement to multiple speakers at arbitrary positions;

first and second collecting sections spaced apart from each other and collecting sound output from the speakers with the supplied TSP measurement signal;

a first distance calculating section calculating the distance from each of the speakers to the first collecting section based on the first collected signal captured by the first collecting section and the TSP measurement signal;

a second distance calculating section calculating the distance from each of the speakers to the second collecting section based on the second collected signal captured by the second collecting section and the TSP measurement signal;

a position information calculating section calculating position information of each of the speakers from the first and second collecting sections based on the distances from each of the speakers calculated by the first and second distance calculating sections to the first and second collecting sections;

an acoustics measuring section measuring acoustics by the multiple speakers placed at the arbitrary positions based on the first and second collected signals and the TSP measurement signal;

a virtual sound image coefficient selecting section selecting an optimum virtual sound image coefficient from multiple virtual sound image coefficients based on the position information calculated by the position information calculating section;

a correction characteristic calculating section calculating an optimum correction characteristic based on the acoustics measured by the acoustics measuring section;

a virtual sound image localization processing section performing virtual sound image localization processing on reproduction signals for the speakers based on the virtual sound image coefficient selected by the virtual sound image coefficient selecting section; and an acoustics correcting section correcting the acoustics of the reproduction signals for the speakers based on the correction characteristic calculated by the correction characteristic calculating section, wherein the acoustics measured by the acoustics measuring section include sound pressure levels of the multiple speakers measured based on the first and second collected signals and the TSP measurement signal, and the correction characteristic calculating section calculates the optimum correction characteristic based on the sound pressure levels of the multiple speakers.

2. The acoustics correcting apparatus according to claim 1, wherein the acoustics measured by the acoustics measuring section further include frequency bands of the multiple speakers measured based on the first and second collected signals and the TSP measurement signal, and the correction characteristic calculating section calculates the optimum correction characteristic is further based on the frequency bands of the multiple speakers.

3. The acoustics correcting apparatus according to claim 1, wherein the acoustics measured by the acoustics measuring section further include frequency response characteristics of the multiple speakers measured based on the first and second collected signals and the TSP measurement signal, and the correction characteristic calculating section calculates the optimum correction characteristic is further based on the frequency response characteristics of the multiple speakers.

4. An acoustics correcting apparatus that corrects the acoustics of multiple speakers placed at arbitrary positions and performs virtual sound image localization processing based on measurement data measured from first and second collected signals obtained by collecting the sound output by supplying a time stretched pulse (TSP) measurement signal for measurement to the multiple speakers first and second collecting sections spaced apart from each other by a predetermined distance, the apparatus comprising:

a first processing section, based on the measurement data, calculating a correction characteristic that corrects acoustics and calculating a virtual sound image characteristic coefficient for performing virtual sound image localization processing;

a storage section storing an acoustics measuring program causing to measure the measurement data based on the first and second collected signals, a virtual sound image localization processing program causing to perform virtual sound image localization processing on reproduction signals for the speakers based on the virtual sound image characteristic coefficient, and an acoustics correcting program correcting the acoustics of the reproduction signals for the speakers based on the correction characteristic; and a second processing section reading the acoustics measurement program to supply the TSP measurement signal for measurement to the multiple speakers, measuring the acoustics of the speakers from first and second collected signals by collecting the sound output from the multiple speakers that receive the supply of the TSP measurement signal by the first and second collecting sections and calculating the distances from the speakers to the first and second collecting sections from the first and second collected signals and calculating position information of the speakers from the distances, wherein the first processing section calculates the correction characteristic based on the acoustics measured by the second processing section and selects an optimum virtual sound image coefficient based on the position information calculated by the second processing section; and the second processing section performs virtual sound image localization processing on the reproduction signals and corrects the acoustics based on the correction characteristic and the virtual sound image characteristic coefficient, which are calculated by the first processing section, by reading the virtual sound image localization processing program and acoustics correcting program, wherein the acoustics measuring program is configured to measure sound pressure levels of the multiple speakers based on the first and second collected signals and the TSP measurement signal, and correct the acoustics of the reproduced signal based on the measured sound pressure levels.

5. The acoustics correcting apparatus according to claim 4, wherein the acoustics measuring program is further configured to measure frequency bands of the multiple speakers based on the first and second collected signals and the TPS measurement signal, and correct the acoustics of the reproduced signal based on the measured frequency bands of the multiple speakers.

6. The acoustics correcting apparatus according to claim 4, wherein the acoustics measuring program is further configured to measure frequency response characteristics of the multiple speakers based on the first and second collected signals and the TSP measurement signal, and correct the acoustics of the reproduced signal based on the measured frequency response characteristics.

* * * * *